US005588566A

United States Patent [19]

de Laforcade et al.

[11] Patent Number: 5,588,566

[45] Date of Patent: Dec. 31, 1996

[54] DEVICE FOR ACTUATING A DISPENSING MECHANISM SUCH AS A VALVE FITTED TO A PRESSURIZED AEROSOL CONTAINER

[75] Inventors: Vincent de Laforcade, Rambouillet; Franck Lacout, Athis-Mons, both of France

[73] Assignee: L'Oreal, Paris, France

[21] Appl. No.: 610,291

[22] Filed: Mar. 4, 1996

[30] Foreign Application Priority Data

Mar. 3, 1995 [FR] France ..... 95 02499

[51] Int. Cl.[6] ..... B65D 83/22

[52] U.S. Cl. ..... 222/402.11; 222/402.13

[58] Field of Search ..... 222/153.11, 402.11, 222/402.13

[56] References Cited

U.S. PATENT DOCUMENTS

| | | | |
|---|---|---|---|
| 3,169,672 | 2/1965 | Soffer et al. | 222/402.11 X |
| 3,184,116 | 5/1965 | Huling | 222/402.1 |
| 3,314,576 | 4/1967 | Focht et al. | 222/402.13 |
| 3,642,179 | 2/1972 | Micallet | 222/402.13 X |
| 3,651,993 | 3/1972 | Venus, Jr. | 222/402.11 X |
| 4,067,482 | 1/1978 | Vogel et al. | 222/402.11 X |
| 4,171,758 | 10/1979 | Corba | 222/402.11 |
| 4,424,920 | 1/1984 | Tada | 222/402.11 |
| 4,752,020 | 6/1988 | Grueter et al. | 222/402.11 X |
| 5,137,180 | 8/1992 | Kieras | 222/402.13 X |

FOREIGN PATENT DOCUMENTS

| | | |
|---|---|---|
| 0042039 | 12/1981 | European Pat. Off. . |
| 2387168 | 11/1978 | France . |

*Primary Examiner*—Kevin P. Shaver
*Attorney, Agent, or Firm*—Oliff & Berridge

[57] ABSTRACT

An actuating device for avoiding inadvertent triggering of a dispensing valve, and hence undesired expulsion of packed product, in a simple and economical manner. According to the invention, the device has a fixed annular collar, an actuating plate with a circular base, an articulation area including, for example, a film hinge, and a force activation area. The force activating area of the base includes a radial cutout defining a recess having a bearing surface in which a tongue can engage. The tongue has a free end and a joined end and can assume a locking position and a dispensing position. In the locking position, the free end engages the recess provided in the radial cutout of the plate and abuts the bearing surface to prevent pivoting plate movement. In the dispensing position, the tongue is retracted inside the plate, allowing pivotal movement of the plate around its articulation to the annular collar.

8 Claims, 4 Drawing Sheets

DEVICE FOR ACTUATING A DISPENSING MECHANISM SUCH AS A VALVE FITTED TO A PRESSURIZED AEROSOL CONTAINER

FIELD OF THE INVENTION

The present invention relates to an improved device fitted to a pressurized aerosol-type container for actuating a dispensing mechanism, such as a valve provided with a tubular stem, controlled by pressing or twisting perpendicularly to the stem axis.

BACKGROUND

Actuating devices of the pushbutton type for aerosol-type containers are known having a fixed annular collar and an actuating plate with a circular base pivotally mounted in the annular collar and articulated over a limited area of the periphery of the base to the annular collar. The plate includes an interior axial tube fitted over a control stem of a valve extending from the container. The tube has an interior passage extended by a passage made in a projecting member projecting upward from the plate up to a terminal dispensing nozzle. This is combined, if necessary, with a diffuser grid when the product packed in the container must be applied in the form of a foam. The plate also has on its upper face a force application area essentially diametrically opposite the articulation area on the annular collar.

Force exerted by the user's finger on the force application area of the plate causes the plate to pivot about an articulated member linking the plate to the collar. This articulated member may be, for example, a film hinge. Pivoting of the plate causes downward displacement of the interior axial tube, which engages the control stem to open the valve of the aerosol container, thus causing a given quantity of product to be expelled through the dispensing nozzle provided in the outwardly projecting member of the actuating plate.

Actuation of the device also causes a pivoting movement of the projecting member projecting out from the plate since it is integral with the plate and generally made as one piece therewith.

It will be understood that, conversely, force applied to the projecting member can cause a pivoting movement by the plate and hence undesired expulsion of product.

In certain types of packages, the projecting member is very large in size and extends eccentrically and at a substantial distance above the body of the packing container on which the actuating device is mounted.

In such cases, the risk of the actuating device being triggered inadvertently is substantial. Such inadvertent triggering can occur in particular with packages in which the recipient has a cap covering the actuating device. In this case, if the cap is not lifted off vertically, it can strike the projecting member and thus trigger the valve control.

SUMMARY OF THE INVENTION

The present invention proposes providing an actuating device for avoiding inadvertent triggering of the valve, and hence undesired expulsion of packed product, in a simple and economical manner.

According to the invention, the actuating plate has a radial cutout in the force application area. A tongue joined at one end to the annular collar can engage the radial cutout. The tongue also has a free end and is shaped so that it can assume a first locking position or a second dispensing position. In the locking position, the free end engages a recess provided in the radial cutout of the plate and abuts a bearing surface of the recess to prevent a plate-pivoting movement. The tongue in the locking position projects upward over part of its length from the force application area of the plate. In the second dispensing position, the tongue is retracted inside the plate allowing pivotal movement of the plate around its articulation to the annular collar.

It will be understood that in the locking position the tongue according to the invention constitutes a "flying buttress" between the cylindrical collar and the plate. Accordingly, even if the projecting member from the plate is accidentally pressed in a direction which, in the absence of the tongue, would have caused the plate to pivot, no pivoting of the plate occurs so that inadvertent expulsion of packed product can be prevented.

The entire actuating device according to the invention can of course be made in one plastic casting. In such a device, the tongue is made such that, as it leaves the mold, its free end projects from the upper face of the plate. The free end then engages the radial cutout provided in the plate until the tongue enters the locking position in the recess of the plate. The locking position of the tongue can be entered when the actuating device is placed on the packaging container or even immediately after casting. The free end of the tongue and the recess of the plate defining a bearing surface therefor are formed so as to prevent the tongue from returning from its locking position to the initial casting position.

Upon first use, all the user need do is apply pressure to the part of the tongue which projects from the force application area of the pivoting plate to push the tongue inside the plate. With continuation of the same pressure, movement causes the plate to pivot and hence causes product to be dispensed. When the pressure is released, the plate elastically returns to the locking position.

BRIEF DESCRIPTION OF THE DRAWINGS

For a better understanding of the invention, an embodiment provided as a non-limiting example thereof will be described with reference to the attached drawings wherein.

DETAILED DESCRIPTION OF THE PREFERRED EMBODIMENTS

Figure 2:
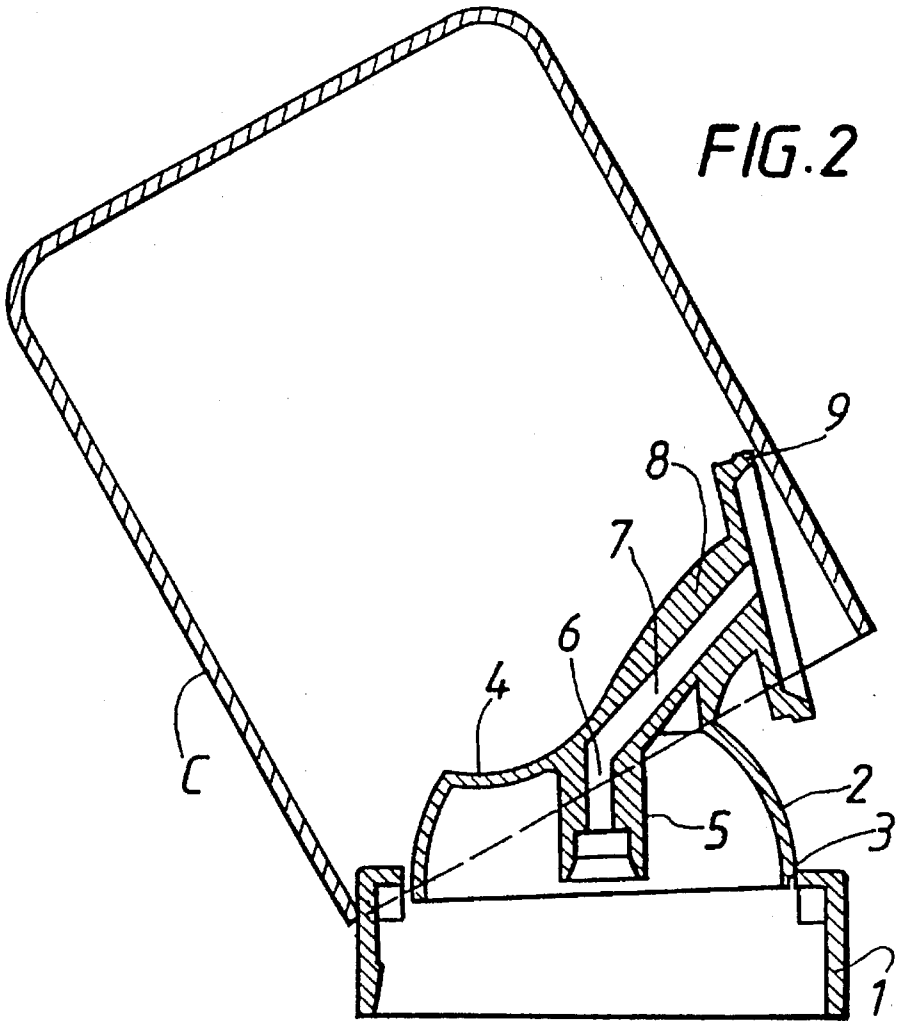
FIG.2 PRIOR ART
FIGS. 1 and 2 are sectional views through a actuating device of the prior art, covered with a cap.
Figure 1:
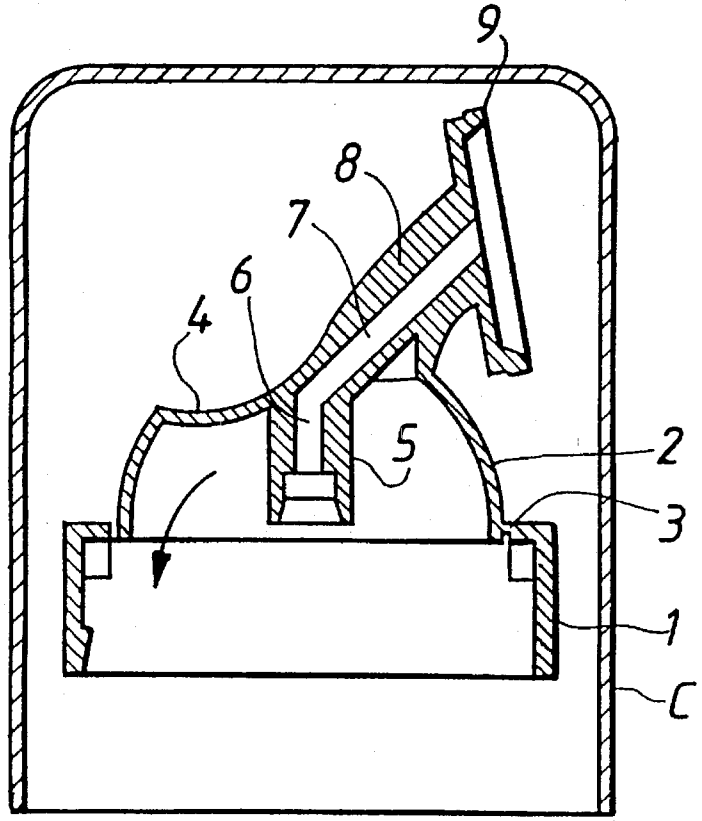
FIG.1 PRIOR ART
Figure 4:
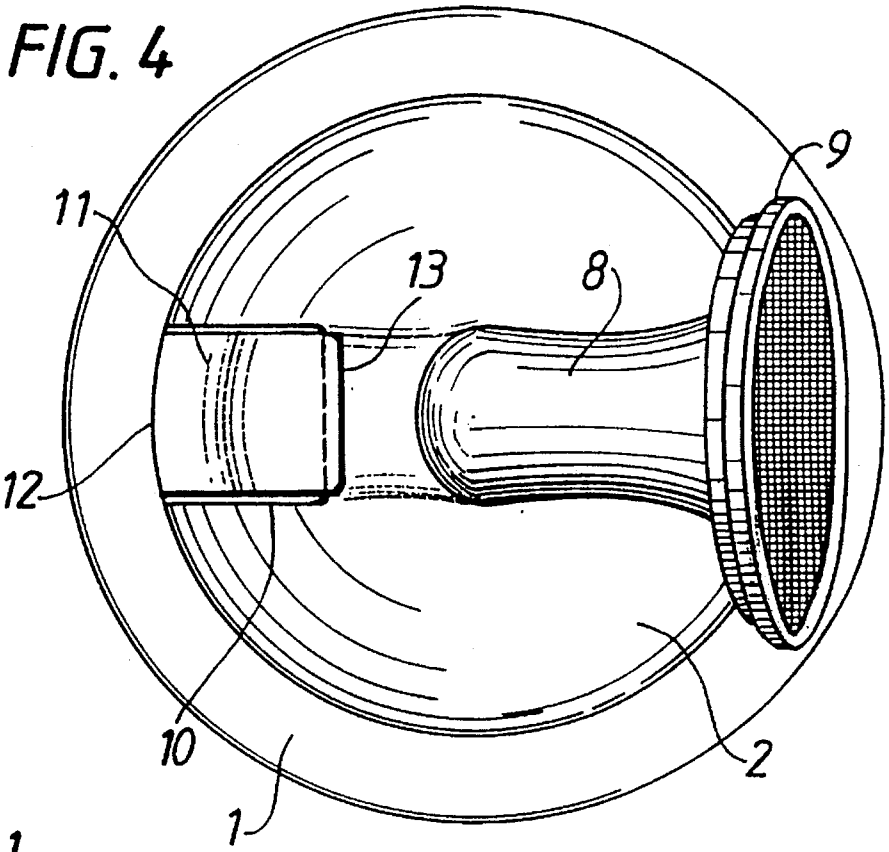
FIG. 4 is a top view of the device of FIG. 3.

Reference will first be made to FIGS. 1 and 2. The represented device is of a type currently used for dispensing hair products in the form of foams. The pressurized aerosol container as well as the dispensing valve fitted to the container are not illustrated as these are conventional and may be of any known type.

FIGS. 1 and 2 show a cap C which is normally placed on containers of this type and is removed prior to use. The actuating device is made in one piece from plastic and comprises an annular collar 1 designed to be attached to the upper part of a pressurized container, an actuating plate 2 with a circular base articulated at its base to the upper end of collar 1 in an articulation area 3 by a connecting member in the form of a film hinge.

Opposite articulation area 3, plate 2 has a force application area 4 which, in the example illustrated, has a curved shape and can be provided on an outer surface thereof with ridges or the like. It will be understood that when the user's finger presses area 4, plate 2 pivots about articulation area 3 in the direction shown by the arrow in FIG. 1.

Inside, the plate has an axial tube 5 shaped interiorly to slide over/fit onto the tubular valve control stem (not shown).

The tube has an interior passage 6 extended upward and outward by a passage 7 of a projecting member 8 projecting from plate 2 upward and outward, the projecting member 8 ending in a disk-shaped end zone 9 provided with a diffuser grid.

As can be seen in FIG. 1, end zone 9 of projecting member 8 extends eccentrically above plate 2 almost in line with annular collar 1.

If, as illustrated in FIG. 2, cap C is pulled off slantwise, it will strike the upper end of zone 9 which, as illustrated, will cause plate 2 to pivot, depressing tube 5 and thus causing the valve to open. This produces undesired dispensing of product.

Reference will now be made to FIGS. 3 to 7 which illustrate the present invention.

The actuating device according to the invention has several characteristics described in connection with FIGS. 1 and 2. Additionally, the claimed invention includes a radial cutout 10 provided in the force application area. A tongue 11, with a bent shape and joined at one end 12 to an upper end of annular collar 1, can engage radial cutout 10 in a location diametrically opposite articulation area 3 of plate 2 on the collar. The tongue has a tapered end 13 having a straight front face 13*a* between an inclined upper surface 13*b* and an inclined lower surface 13*c*.

To receive the free end 13 of tongue 11, plate 2 has a recess defining a straight contact surface 14*a* designed to constitute a bearing surface for front face 13*a* of the tongue. Contact surface 14*a* is provided between two essentially orthogonal contact surfaces, an upper surface 14*b* and a lower surface 14*c*, with surface 14*c* extending by a curved surface 14*d* essentially in the form of an involute to a circle.

Figure 3:
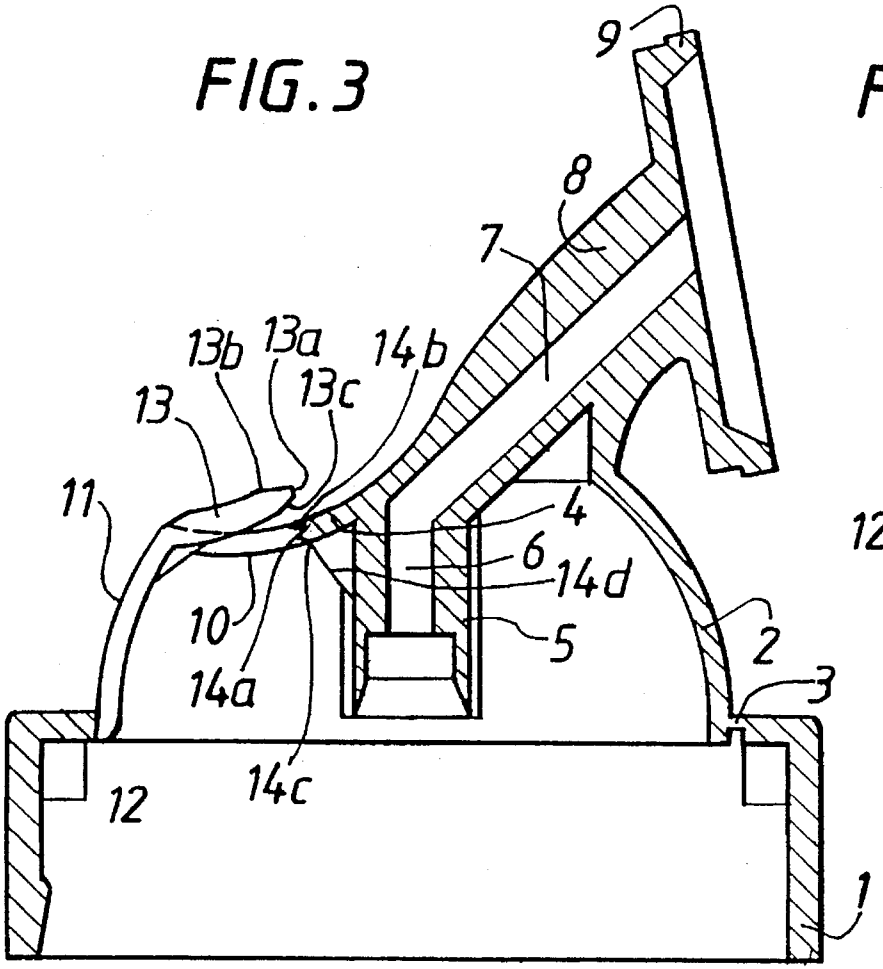
FIG. 3 is a sectional view through a device according to the present invention as the device is formed.

FIG. 3 illustrates the actuating device according to the invention as obtained by casting. It can be seen that free end 13 of tongue 11 projects upward from actuating plate 2.

Figure 5:
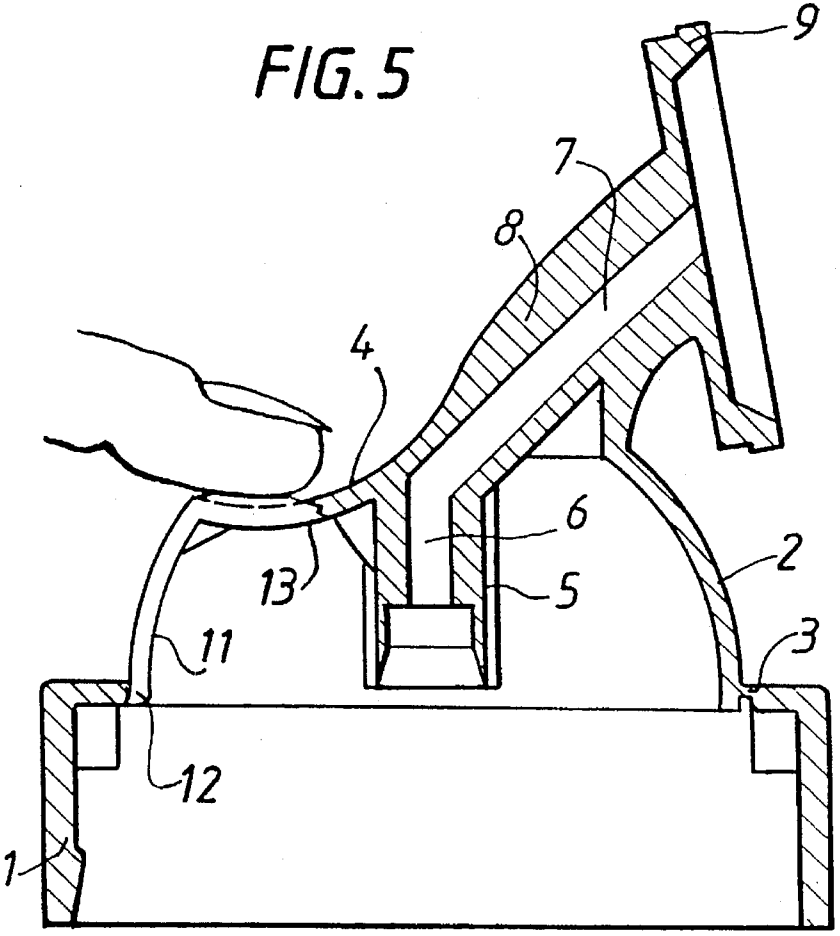

To bring tongue 11 into the locking position, as illustrated in FIG. 5, free end 13 of the tongue is pushed until it snaps into the recess defined in actuating plate 2. Engagement of the tongue is facilitated by the presence of lower surface 13*c* at the end thereof which constitutes an entrance bevel.

As can be seen in FIG. 5, part of the tongue extends upward from support area 4 of plate 2.

If, in this locking position, a leftward force is applied to projecting part 8 as shown in the drawing, particularly to its end zone 9, it will be understood that the tongue will behave like a flying buttress. This is because of the stop produced by front surface 13*a* of the tongue and the opposite contact surface 14*a* of its recess in plate 2, preventing any pivoting movement of plate 2.

Because of the existence of upper contact surface 14*b* of the recess, the snapping effected to bring the tongue into the locking position is irreversible, as the tongue cannot be brought back to its as-cast position illustrated in FIG. 3.

Figure 6:
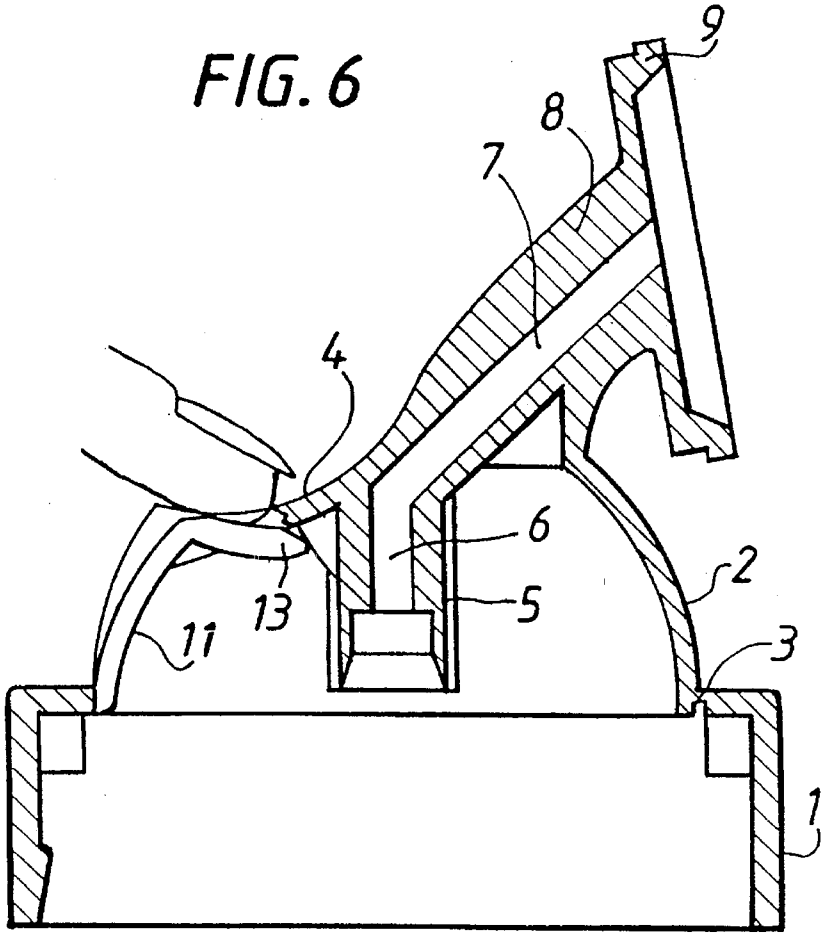
FIGS. 5, 6 and 7 are sectional views similar to those of FIG. 3 illustrating the device according to the invention in a locking position, an intermediate position, and a dispensing position, respectively.
Figure 7:
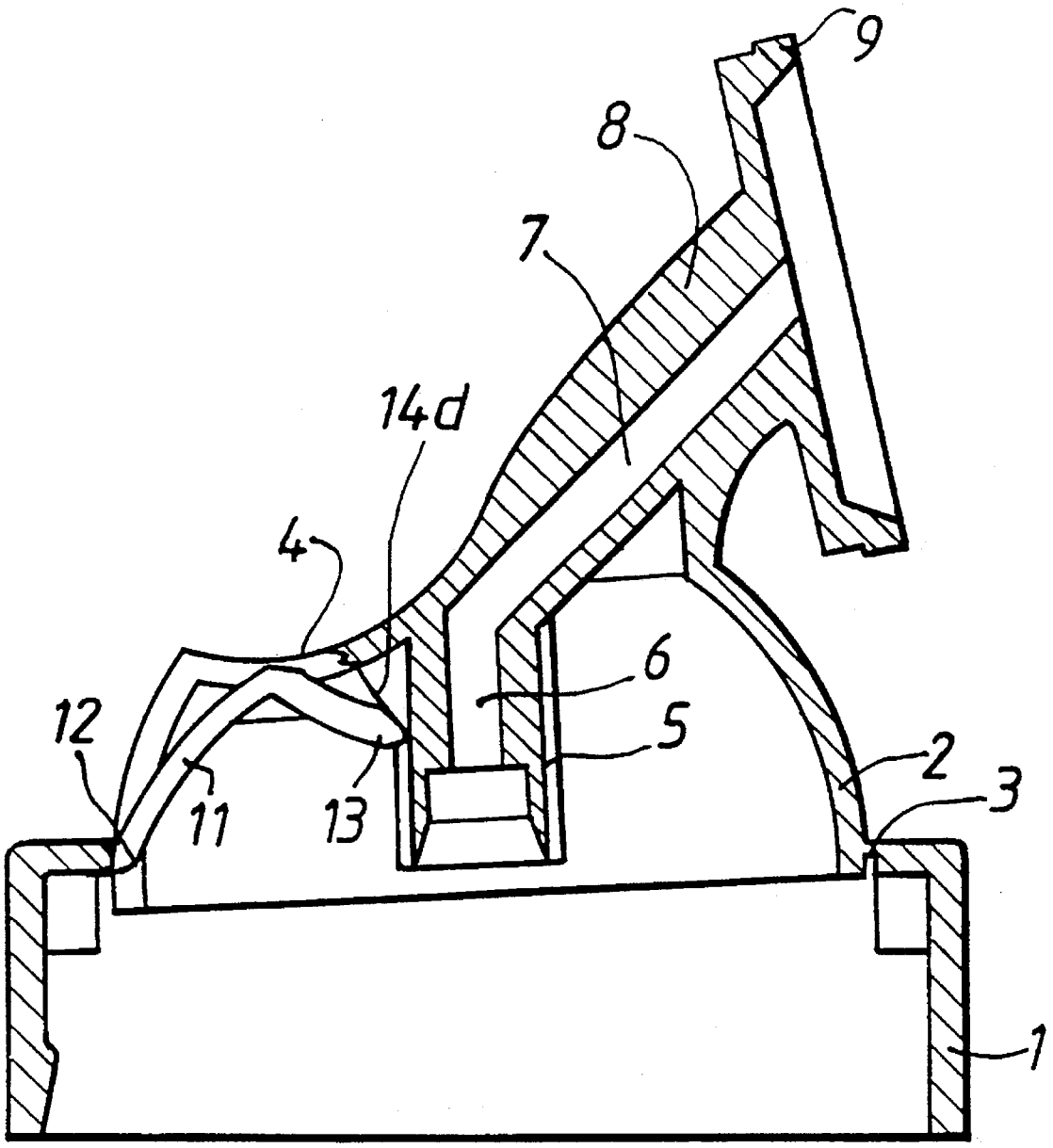

When, as shown in FIGS. 6 and 7, force is applied to the upper face of free end 13 of the tongue, the latter is disengaged from its recess and is guided down along curved contact surface 14*d*.

The same force which caused disengagement of the tongue brings about pressure on the force application surface 4 of the plate and hence pivoting thereof, allowing the product packed to be expelled.

During the movement brought about by the pressure, force application area 4 of the plate will tend to move down away from the axis of the device while the upper supporting surface of the tongue will on the contrary tend to move toward this axis.

Curved contact surface 14*d* along which free end 13 of the tongue moves brings about an accelerated downward movement thereof, preventing any shear effect unpleasant for the user. This curved surface 14*d*, as stated above, preferably has a shape close to that of an involute to a circle and which is the resultant of the rotational paths of force application area 4 around the axis defined by articulation area 3 of plate 2 and the rotational path of the tongue around the axis defined by its connecting area 12 to collar 1.

Once the desired quantity of product has been obtained, the user releases the pressure so that the tongue, because of its elasticity, returns to its locking position illustrated in FIG. 3, once more ensuring protection against inadvertent actuation of the valve.

Although the invention has been described in connection with a particular embodiment, it is evident that the invention is not limited thereto. Various changes and modifications can be made without departing from the framework or spirit embodied by the appended claims.

What is claimed is:

1. An actuating device for a dispensing mechanism fitted to a container, said device comprising:

a fixed annular collar;

an actuating plate with a circular base defining a periphery pivotally mounted in said annular collar and articulated over a limited area of the periphery of said base to said annular collar, said plate having on a lower face an axial tube for engagement with a valve of the container, said tube having an interior passage extended by a passage projecting upward from said plate up to a terminal dispensing nozzle, said plate having on an upper face a force application area essentially diametrically opposite said articulation area on said annular collar;

a radial cutout in said force application area, said radial cutout including a recess defining a bearing surface; and a tongue engageable with said recess, said tongue being joined at one end to said annular collar and having a free end, said tongue being positionable in both a first locking position wherein its free end engages said recess and abuts said bearing surface to prevent pivotal movement of said plate, and a second dispensing position in which said tongue is retracted inside said plate out of engagement with said bearing surface to allow pivotal movement of said plate around said articulated limited area of the periphery of said base.

2. The actuating device according to claim 1, wherein said free end of said tongue and said recess of said plate defining said bearing surface are shaped to prevent the tongue from movement outward from the locking position.

3. The actuating device according to claim 1, wherein said tongue has a tapered end comprising a straight front face and upper and lower inclined surfaces.

4. The actuating device according to claim 3, wherein said bearing surface is shaped to mate with said straight front face of said tongue.

5. The actuator device according to claim 3, wherein an upper surface of said recess extends above said bearing surface and extends outward from said bearing surface toward said tongue.

6. The actuator according to claim 1, wherein said plate is provided with a curved contact surface below said recess for guiding said tapered end of said tongue during movement of said tongue from the locking position to the dispensing position.

7. The actuator according to claim 1, wherein said tongue projects upward over at least a part of its length from said force application area of said plate.

8. The actuator of claim 1, wherein said plate is substantially dome-shaped.

* * * * *